US006452135B1

(12) United States Patent
Johnson, III

(10) Patent No.: US 6,452,135 B1
(45) Date of Patent: Sep. 17, 2002

(54) HEATING UNIT WITH SELECTIVELY ENERGIZED HEATING MODULES

(76) Inventor: Joe P. Johnson, III, 173 Red Tail Hawk Loop, Pawleys Island, SC (US) 29585

( * ) Notice: Subject to any disclaimer, the term of this patent is extended or adjusted under 35 U.S.C. 154(b) by 0 days.

(21) Appl. No.: 09/846,570

(22) Filed: May 1, 2001

(51) Int. Cl.[7] ..... H05B 3/00

(52) U.S. Cl. ..... 219/480; 219/478; 219/388; 219/477; 392/417

(58) Field of Search ..... 219/480, 508, 219/478, 388, 486–487, 476–477; 392/417, 407, 411; 34/266, 273

(56) References Cited

U.S. PATENT DOCUMENTS

| | | | | | |
|---|---|---|---|---|---|
| 735,798 | A | * | 8/1903 | McElroy | 392/407 |
| 1,533,227 | A | | 4/1925 | Colby | |
| 1,565,539 | A | * | 12/1925 | Woodson | 392/432 |
| 1,860,934 | A | | 5/1932 | Malone | |
| 2,559,410 | A | * | 7/1951 | Doyle | 392/407 |
| 2,762,896 | A | | 9/1956 | Pendleton | |
| 2,912,555 | A | | 11/1959 | Jamison | |
| 3,040,807 | A | * | 6/1962 | Chope | 34/266 |
| 3,240,915 | A | * | 3/1966 | Carter et al. | 392/416 |
| 3,265,865 | A | | 8/1966 | Hager, Jr. | |
| 3,475,588 | A | * | 10/1969 | McMaster | 219/203 |
| 3,525,850 | A | | 8/1970 | Hager, Jr. | |
| 3,783,238 | A | * | 1/1974 | Dietz et al. | 219/395 |
| 3,832,524 | A | * | 8/1974 | Takiguchi | 219/216 |
| 3,956,612 | A | | 5/1976 | Ballard et al. | |
| 4,101,759 | A | * | 7/1978 | Anthony et al. | 392/411 |
| 4,202,112 | A | * | 5/1980 | Eltz et al. | 34/266 |
| 4,545,131 | A | * | 10/1985 | Ericsson | 34/267 |
| 4,551,614 | A | | 11/1985 | Johnson | |
| 4,565,917 | A | * | 1/1986 | Furtek | 219/388 |
| 4,824,464 | A | * | 4/1989 | Perin et al. | 65/106 |
| 5,126,000 | A | * | 6/1992 | Takai et al. | 156/285 |
| 5,155,798 | A | * | 10/1992 | Denend | 392/424 |
| 5,158,132 | A | * | 10/1992 | Guillemot | 165/206 |
| 5,223,290 | A | * | 6/1993 | Alden | 426/243 |
| 5,249,255 | A | * | 9/1993 | Fuqua et al. | 392/412 |
| 5,337,393 | A | * | 8/1994 | Reunamaki | 392/417 |
| 5,470,367 | A | * | 11/1995 | Salonen et al. | 65/162 |

* cited by examiner

*Primary Examiner*—John A. Jeffery
(74) *Attorney, Agent, or Firm*—Dority & Manning, P.A.

(57) ABSTRACT

A heating unit is provided with heating modules in a housing. Each module has a heating element. An electrical connection is attached to each heating module such that each heating module can be selectively energized to heat its heating element to a high temperature. Alternative embodiments and a related method of rapid heat processing are also disclosed.

18 Claims, 6 Drawing Sheets

HEATING UNIT WITH SELECTIVELY ENERGIZED HEATING MODULES

FIELD OF THE INVENTION

The invention relates generally to a heating unit. More particularly, the invention relates to a heater with modules that may be selectively energized for heating zones or portions of zones.

BACKGROUND OF THE INVENTION

Various types of heating units have been developed for rapidly radiantly heating objects to a high temperature such as around 1500° F. One such radiant heater is described in U.S. Pat. No. 3,525,850, which discloses a foil ribbon adapted to be heated by electricity to a temperature in the range of about 1200° F. to 1800° F. U.S. Pat. No. 3,956,612 describes an electrical heater with modular units that may be assembled as an array to accommodate various lengths and widths of objects to be heat processed.

At least one disadvantage found in the prior art is that a radiant heater or a modular array of radiant heaters must be energized in its entirety. If a manufacturer needs only a "limited run" to produce a small quantity or partial order of goods, use of the older heaters can result in wasted electricity and increased manufacturing costs. With older heaters, the manufacturer may have to choose to: delay smaller orders until additional small or partial orders are received to maximize an entire radiant heater array; decline to accept smaller orders; or incur higher energy costs.

Another potential disadvantage in the prior art is associated with heater maintenance. When an older heater's heating element fails, for instance, or requires maintenance, the entire heater may be unusable until the heating element is repaired or replaced. This is especially so where the heater elements are interconnected in electrical series. Maintenance "down time" thus can lead to higher costs due to loss of manufacturing productivity.

SUMMARY OF THE INVENTION

According to an aspect of the invention, a heating unit is disclosed which has a housing and heating modules that may be joined contiguously in the housing. Each of the heating modules may have an electrical connection attached and each may have a heating element such as a foil that can be heated to a high temperature by passage of electricity through the foil. Preferably, an electrical power control apparatus is provided to selectively energize each electrical connection, which in turn selectively energizes the heating module to heat its foil element.

In another aspect of the invention, the heating unit preferably has connection elements for releasably connecting heating modules to each other. In this manner, the heating unit may be more easily maintained by removing and repairing or replacing heating modules without affecting the operability of other heating modules.

According to another aspect of the invention, a heating unit is provided which is capable of selectively heating multiple zones. As in the previously described embodiment, the heating unit has a housing and a plurality of heating modules and radiant heating elements adapted to be electrically heated to a high temperature. In this embodiment, the heating modules may be arranged in any relative geometry. For instance, the heating modules may be disposed laterally to one another, or both laterally and longitudinally, as required, to provide a variable arrangement for radiant heat.

Variably arrayed geometries are possible since each heating module can be selectively and individually energized.

To selectively and individually energize each heating module, the heating unit has means for selectively energizing the modules. Preferably, the energizing means includes an electricity source wire that can be energized to supply electricity to the radiant heating element or connected to neutral so that the radiant heating element is not energized. The energizing means may also include means for selecting any number of electricity source wires. The selecting means may be a controller device, or group of devices, that serves to govern electrical power to be delivered to the wires.

According to another aspect of the invention, a method is disclosed for rapid heat processing. The method includes the steps of arranging radiant heating modules in spaced relationship to each other; selectively energizing any of the radiant heating modules using an electrical control apparatus; and providing the radiant heat at a predetermined temperature for a predetermined time.

The disclosed method may include the substeps of energizing at least two of the radiant heating modules and adjusting current between them such that a temperature differential exists across the radiant heating modules.

Additional substeps may include selecting phase, for example, on line one (L1) to supply electricity to one of the heating modules and selecting neutral on line two (L2) for another heating module.

Another aspect of the disclosed method may include removing and repairing or replacing a heating module while other heating modules remain operable to reduce production down time.

Other aspects and advantages of the invention will be apparent from the following description and the attached drawings, or can be learned through practice of the invention.

BRIEF DESCRIPTION OF THE DRAWINGS

The above and other aspects and advantages of the present invention are apparent from the detailed description below and in combination with the drawings in which.

Figure 1:
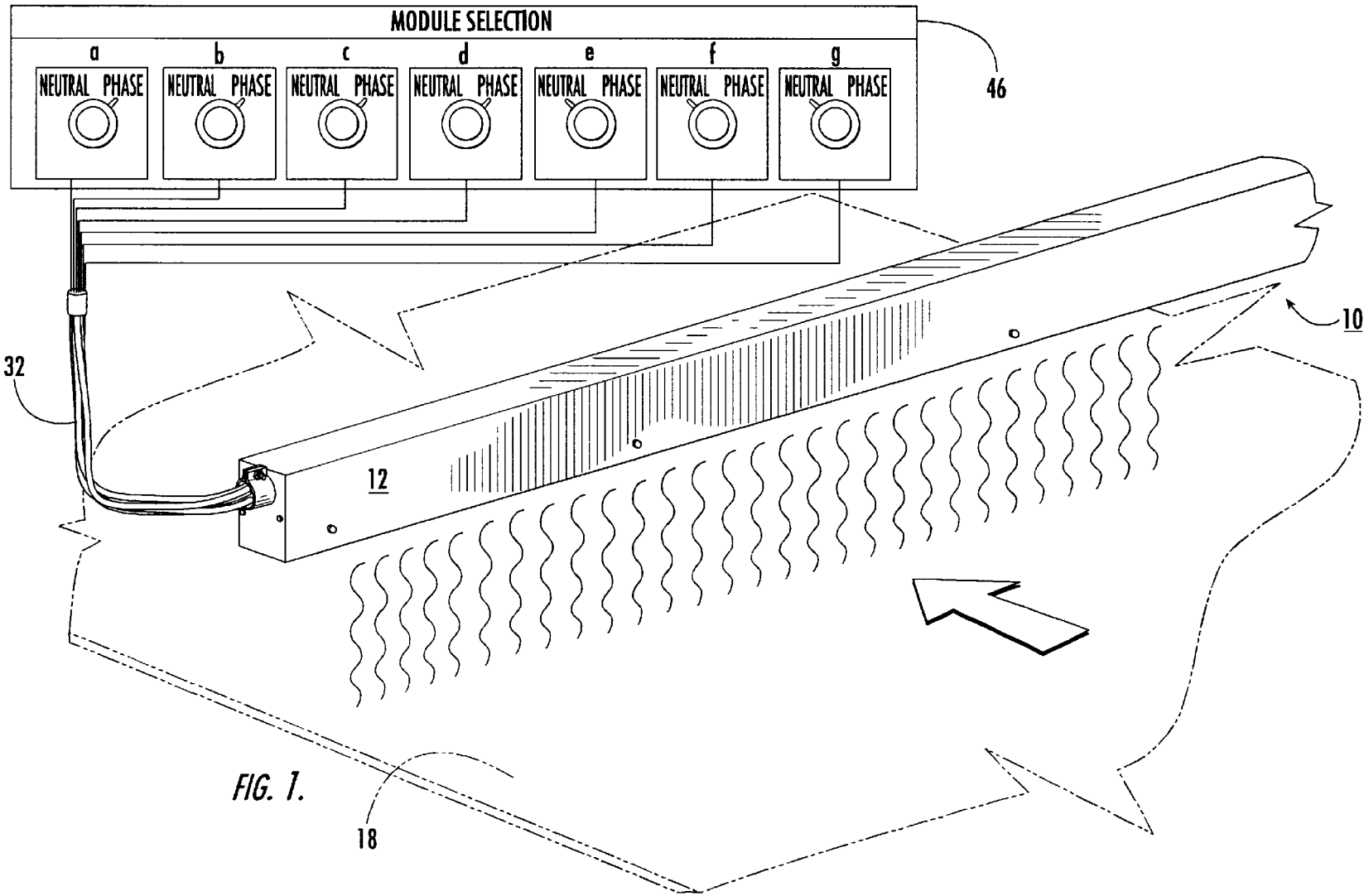
FIG. 1 is a partial perspective view of an exemplary embodiment of a heating unit according to the invention in which some heating modules are selectively energized.

Repeat use of reference characters in the present specification and drawings is intended to represent same or analogous features or elements of the invention.

DETAILED DESCRIPTION OF THE DRAWINGS

Detailed reference will now be made to the drawings in which examples embodying the present invention are shown. The drawings and detailed description provide a full and detailed written description of the invention and the manner and process of making and using it, so as to enable one skilled in the pertinent art to make and use it. The drawings and detailed description also provide the best mode of carrying out the invention. However, the examples set forth herein are provided by way of explanation of the invention and are not meant as limitations of the invention. The present invention thus includes modifications and variations of the following examples as come within the scope of the appended claims and their equivalents.

Figure 2:
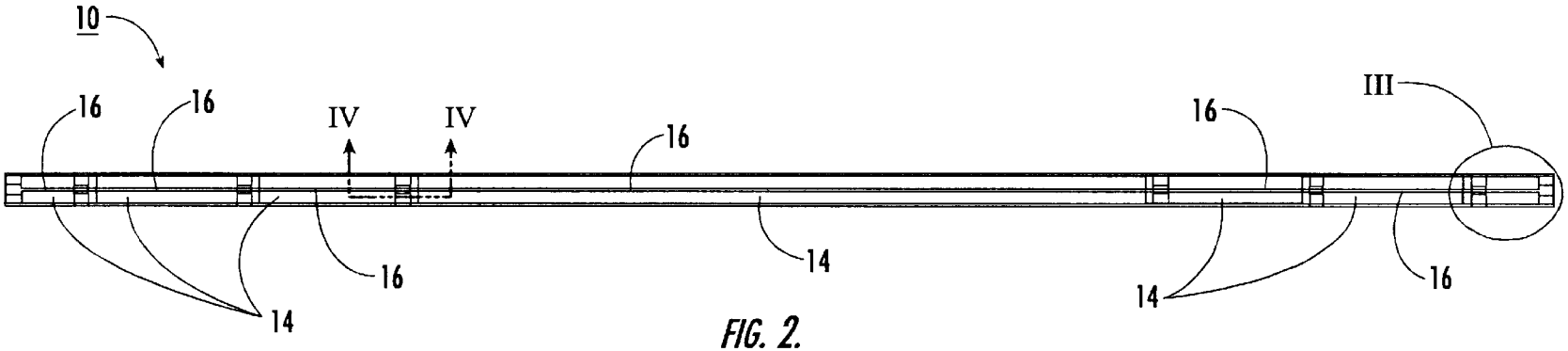
FIG. 2 is a plan view of the embodiment of FIG. 1 cut away on the top to reveal heating elements.

As broadly embodied in FIGS. 1 and 2, a modular electric infrared heater having electrical connections to a power source (not shown) is provided. As the Figures illustrate, heating unit 10 has a housing 12, a plurality of heating modules 14 disposed within the housing 12, and a foil or radiant heating element 16 disposed on each of the plurality of heating modules 14. Heating unit 10 also includes means for selectively energizing the heating modules 14. The means for selectively energizing electrically connect the power source to the heating modules 14. Such heating unit 10 can be used to heat for example web material 18 to a desired temperature as illustrated in FIG. 1. It should be appreciated that the present invention has utility for heating any type of material or article and that the type of articles to be heated does not in any way limit the invention.

With more particular reference to the Figures, heating unit 10 has a housing 12 with a plurality of heating modules 14 disposed within the housing 12. As shown, housing 12 is a linear, channel-shaped member formed of two joined L-shaped members 20 (see FIG. 6). Housing 12 may include two C-shaped members 22 oppositely disposed within the channel formed by the L-shaped members 20 with their faces 24 open to each other. The C-shaped members 22 hold, for instance, ceramic elements 28 and 30, discussed further herein. The L-shaped 20 and C-shaped 22 members and housing 12 may be metal or any material suitable to accommodate heating modules 14 and may be constructed in sections or as a continuous piece. Additionally, housing 12 can be shaped along its length in cross-section other than as shown, such as square, annular, irregular, etc. and be within the scope of the invention.

It is intended that the disclosed embodiment may provide heating in selectable zones of variable geometries. Therefore, the heating unit 10 is not limited to the exemplary embodiment having a longitudinally-oriented array of heating modules 14 as shown in FIGS. 1 and 2. Further, heating modules 14 may be of various sizes relative to one another as shown in FIG. 2, or the heating modules 14 can be uniform.

Figure 6:
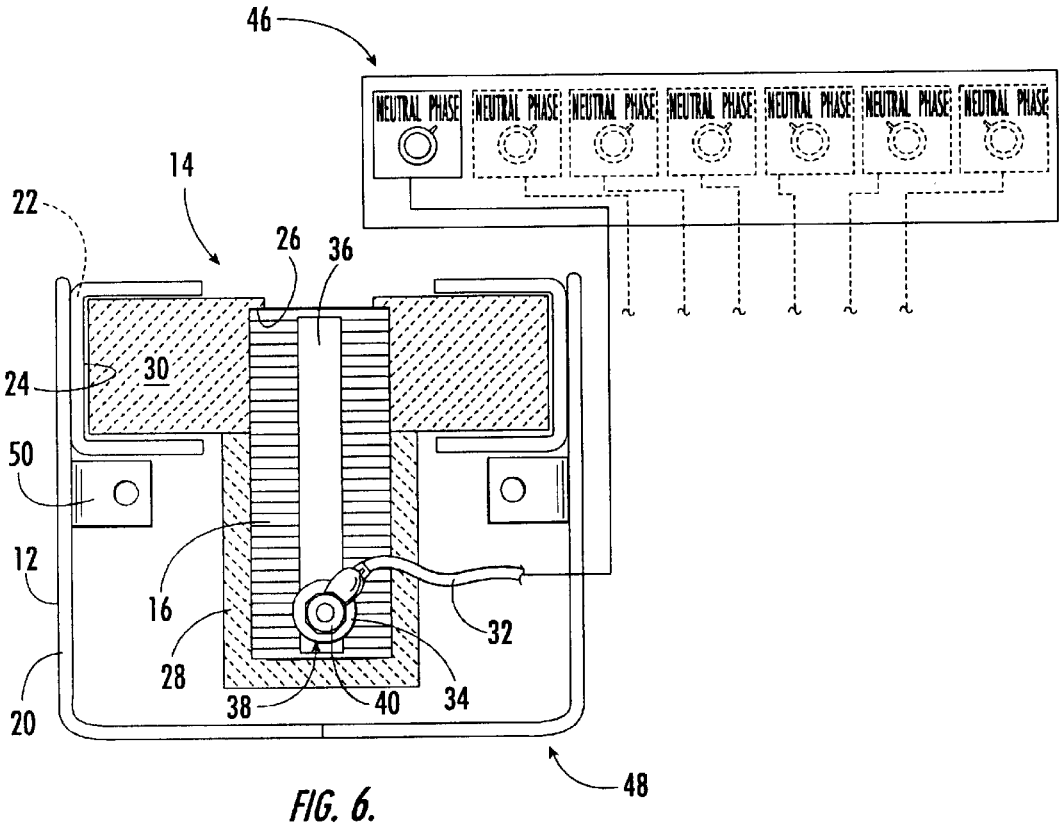
FIG. 6 is an end view of the heating unit taken in the direction of line VI—VI in FIG. 5 and showing an electrical power control apparatus connected to the heating module via an electricity source wire (an optional end cap is removed and not shown)

According to one aspect of the invention and as shown in FIG. 2 and FIG. 6, heating elements 16 are disposed on each of the heating modules 14. Heating element 16 may be a thin metal foil ribbon, generally corrugated and may be located in an elongate channel 26 formed in first ceramic element 28 and second ceramic element 30 along the length of heating unit 10. For example, FIG. 6 illustrates heating element 16 disposed in the elongate channel 26 on second ceramic element 30. Heating element 16 may be attached to housing 12 and held in place in various other ways if desired.

Figure 4:
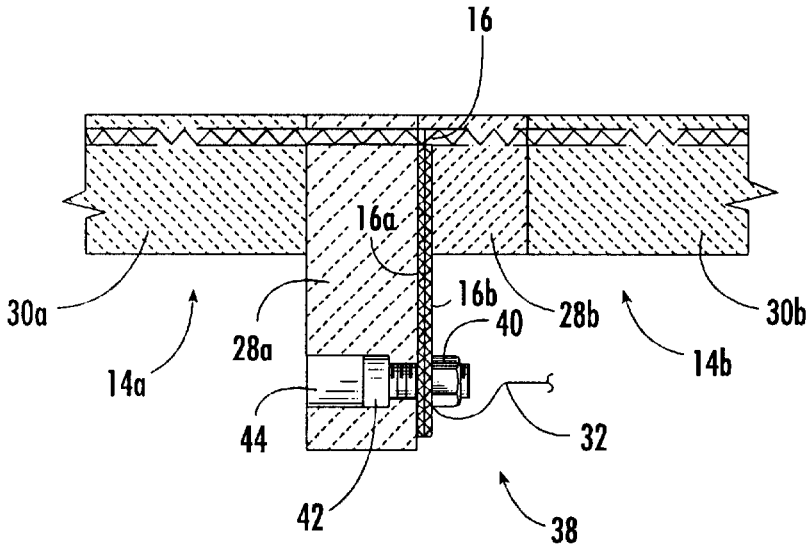
FIG. 4 is a sectional side view of the heating unit taken along line IV—IV in FIG. 2.

FIGS. 1, 4, and 6 further illustrate an aspect of the invention in which heating modules 14 are connected to a power source by the means for selectively energizing. Specifically, to connect a heating element 16 of the heating module 14 to the power source, the means for selectively energizing may include a wire element 32, a washer 34, an attachment member 36 such as a piece of stainless steel to provide a strong, flat surface for bolting, and a connection element 38 disposed at each end of heating element 16. However, it should be understood that means for selectively energizing may be any suitable electrical connection to provide electrical power from a power source to the heating element 16.

Figure 3:
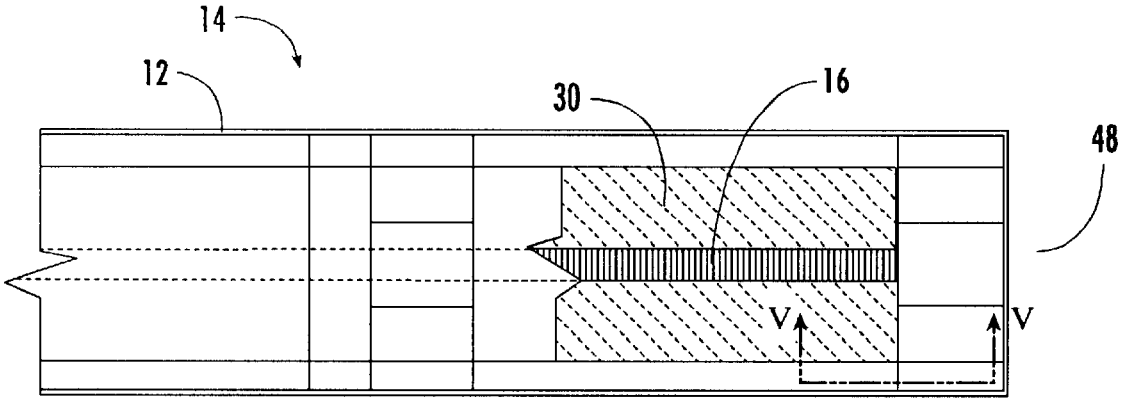
FIG. 3 is an enlarged view of an end of the heating unit taken at area III in FIG. 2 and partially cut away to show the heating element.

As shown in detail in FIG. 3, each heating module 14 holds the heating element 16 in longitudinal fashion within channel 26. FIG. 6 illustratively shows heating element 16 of FIG. 3 bending from the longitudinal through approximately 90° and terminating proximate nut 40 discussed below.

As seen in both FIGS. 3 and 6, heating module 14 can utilize a variety of types of heating elements 16 such as any metallic ribbon or foil element. Additionally, it is intended that heating element 16 can be variously oriented in heating module 14, for instance, laterally.

As discussed, the FIG. 4 embodiment employs ceramic elements 28 and 30 to hold heating element 16 for ease of installation and maintenance. However, elements 28 and 30 may be unitarily constructed, or additional segmented elements may be provided. Ceramic elements 28 and 30 may be "Maronite Type C" calcium silicate blocks, but many other compositions may be substituted for ceramics in elements 28 and 30. It is contemplated that the elements 28 and 30 may be formed of any suitable material, such as cellular fiber cement compositions, mineral wool, and various other ceramic products.

Also shown in FIG. 4 in detail, heating modules 14*a* and 14*b*, by way of example, may be contiguously joined together within housing 12 by the connection element 38. As shown, each heating module 14*a* and 14*b* may have first end ceramic elements 28*a*, 28*b* and second central ceramic elements 30*a*, 30*b*, respectively. Further shown, the connection element 38 may be a nut 40 and bolt 42 or other suitable connector known to those skilled in the art to releasably connect the heating modules 14*a* and 14*b* and to position them properly in relation to housing 12 and to each other.

To assemble the exemplary heating unit 10 in FIG. 4, heating modules 14*a* and 14*b* each have a heating element 16*a* and 16*b*, respectively. Each heating element 16*a* and 16*b* has an attachment member 36 (see FIG. 6 for instance) that may be spot-welded or otherwise attached to its respective heating element 16. The heating elements 16*a* and 16*b* are positioned adjacent each other such that their respective attachment members 36 are facing each other.

Once heating modules 14*a* and 14*b* are arranged with their respective heating elements 16*a* and 16*b* adjacent each other in the desired position, the heating modules 14*a* and 14*b* are secured to each other by nut 40 and bolt 42 through aligned holes (not shown) in the attachment members 36. Illustratively, FIG. 4 shows nut 40 releasably attached to bolt 42, which is inserted through a bore 44 in first ceramic element 28*a*. In this embodiment, first ceramic element 28*a* depends perpendicular from second ceramic element 30*a*. First ceramic element 28*a* may be more durable than second ceramic element 30*a* in order to accommodate the bore 44 and connection element 38.

Various ceramic element configurations are contemplated. For instance, ceramic element 28*b* could be the same height as ceramic element 28*a* of FIG. 4, such that ceramic element 28*b* and ceramic element 28*a* both accommodate a bolt longer than bolt 42. Likewise, ceramic element 28*a* could be shorter than ceramic element 28*b* and nut 40 could instead be inserted in a bore through ceramic element 28*b*. Nut 40, bolt 42, bore 44, first ceramic element 28 and second ceramic element 30 are for illustration purposes only and any suitable connection can be made between heating modules 14.

Based upon the number of heating modules 14 desired, the heating modules 14 can be slid longitudinally or axially inserted into the housing 12. It is intended that although the exemplary embodiments of the Figures show a plurality of heating modules 14 form-fitted to housing 12 to render them suitable for slidable positioning, alternative embodiments are possible in which heating modules 14 can be axially inserted into housing 12. A drop-in and pull-out configuration may be preferable for accessing heating modules 14 or other heating unit 10 components for maintenance. If so, the connection between units provided by the nuts 40 and bolts 42 would be reconfigured or relocated, or the housing 12 would be reconfigured, so that access is available to connect and disconnect the modules 14. Further, spacers or other elements could be added between heating modules 14 to create a jointed but continuous electric infrared heater having large, small, or no separation between heating modules 14.

Figure 5:
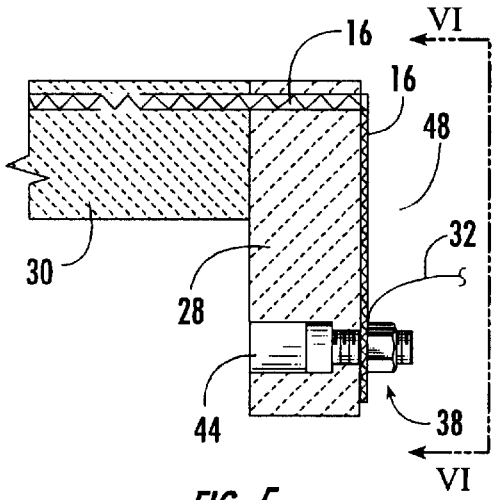
FIG. 5 is a sectional side view of the heating unit taken along line V—V in FIG. 3.

As FIGS. 4, 5 and 6 illustrate, means for selectively energizing may include an electricity source wire 32 in electrical communication with heating element 16 and depending from proximate connection element 38. The wire 32 may be constructed of any suitable material such as tungsten. The wire 32 can be phase selected, for example, "L1" to supply electricity to the heating element 16, or "L2" for neutral.

FIG. 5 depicts a heating module 14 disposed at an end 48 of heating unit 10. FIG. 5 illustrates that connection element 38 can be utilized to secure the heating element 16 to the heating module 14, but in this case, not joining together a pair of heating modules 14 as in FIG. 4.

FIG. 6 shows the end 48 of heating unit 10 as seen in FIG. 3. Heating element 16 is located in channel 26 and is held in place by washer 34, nut 40, and bolt 42. Washer 34 or other suitable instrumentality may reduce contact resistance to prevent high resistance contact failure or to more securely connect heating element 16 and wire 22. However, washer 34 is not required.

Also shown in FIG. 6, the wire 32 is connected to means for selecting any number of electricity source wires. Means for selecting may be a manual control device such as the electrical power control apparatus 46 as illustrated. However, means for selecting could be a rheostat, knife switch, computer control, etc. An optional end cap or cover (not shown in FIG. 6) can be secured to the end cap securement elements 50 to better protect the end 48 of the unit if desired.

Figure 7:
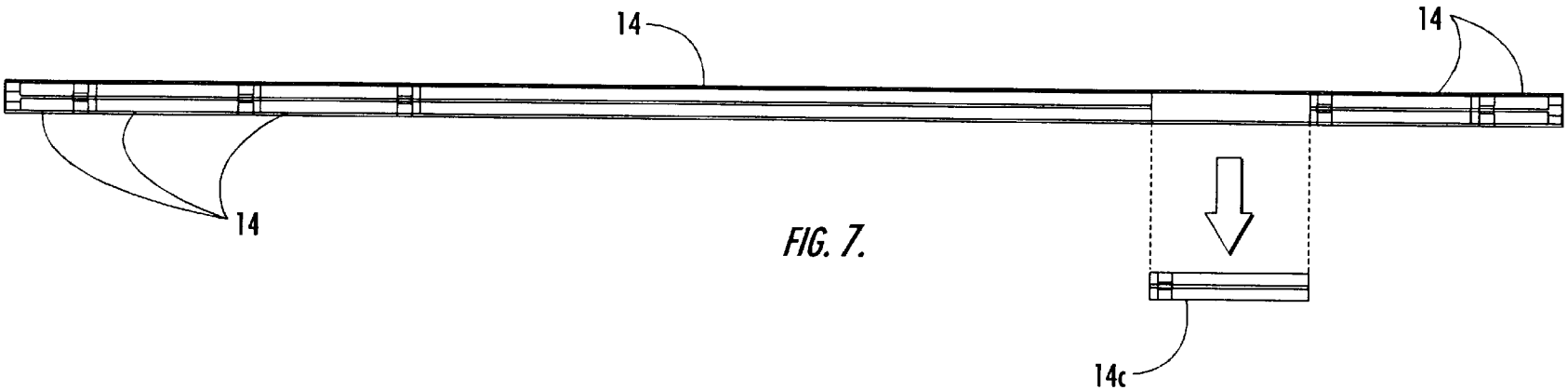
FIG. 7 shows the embodiment of FIG. 2 with a heating module 14 removed for maintenance.

FIG. 7 shows the embodiment of FIG. 2 with a heating module 14*c* removed for maintenance. The other heating modules 14 remain operable to be selectively energized by the means for selecting.

Figure 8:
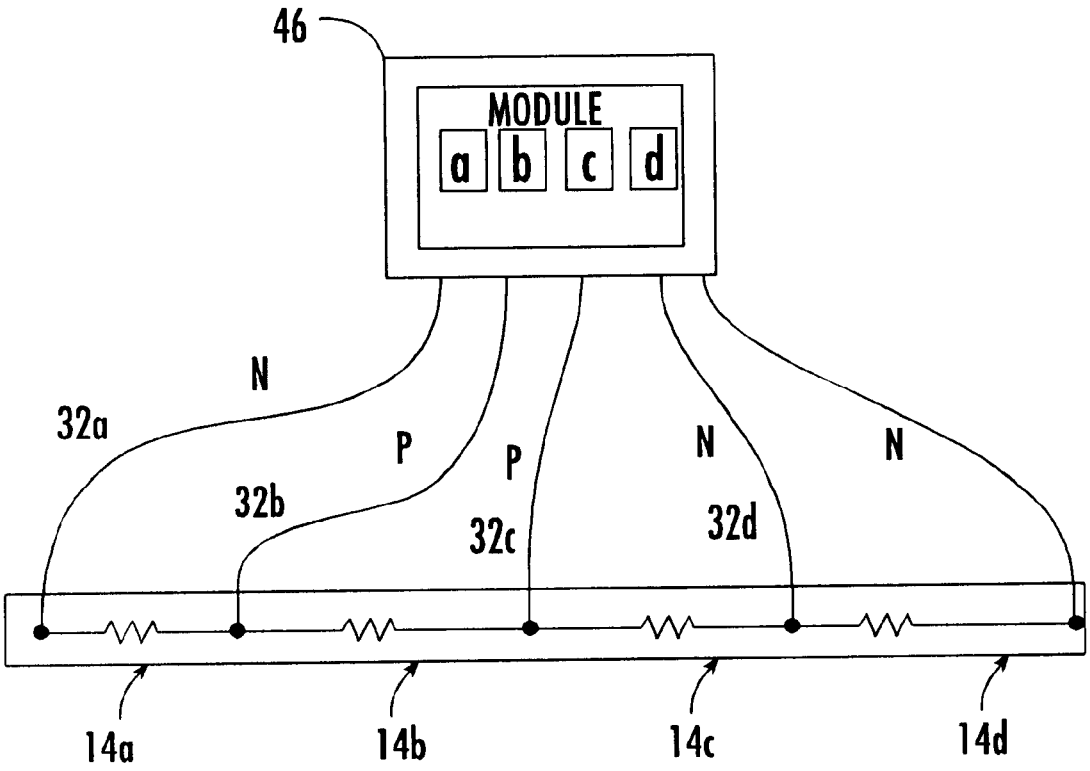
FIG. 8 illustratively shows a method of selectively energizing two heating modules 14*a* and 14*c* by selecting phase on L1 and neutral on L2 to create a potential difference across heating modules 14*a* and 14*c*, whereby heating module 14*b* has no potential difference and does not generate heat.

FIG. 8 illustrates schematically one arrangement of electrical connections that can selectively energize heating modules, for instance, heating modules 14*a* and 14*c*. The electrical power control apparatus 46 is configured to selectively energize wires 32. For example, as shown, wires 32*b* and 32*c* are selected L1 or "P" for phase to energize. Wires 32*a* and 32*d*, for example, are selected "N" or neutral L2 and are not positively energized. Both sides of heating element 14*b* are connected to phase; thus, there is no potential difference across heating element 14*b*. Heating modules 14*a* and 14*c* have a potential difference across them, and thus generate heat while heating module 14*b* does not. Additionally, a rheostat-type function may be incorporated in the means for selecting such that the electric current is varied between two or more heating modules 14 to create a temperature differential between the modules 14 if desired.

The following is an explanation of the method of operation of one embodiment of the invention with particular reference to FIGS. 1, 7 and 8. As seen in FIG. 1, the plurality of radiant heating modules 14 is arranged based upon a desired geometry to heat web material 18 or other article. The electrical control apparatus 46 is activated to make an electrical connection with the heating modules 14 and to selectively energize any number of them. Desired electrical currents are set at the electrical control apparatus 46 such that heating modules 14 produce radiant heat at a predetermined temperature. A predetermined time may be set at the electrical control apparatus 46 such that radiant heat is produced automatically as predetermined, or the time can be controlled manually.

The method of operation may include varying an electricity supply to the radiant heating modules 14 such that a temperature differential exists across the two or more of the heating modules 14. For instance, in FIG. 8, heating modules 14*a* and 14*b* may each receive different electric current supplies such that heating module 14*a* radiantly heats at 1200° F. and heating module 14*b* at 1500° F. Alternatively, the method may include creating a first potential difference across the radiant heating modules 14*a* and 14*b* and a second potential difference across heating modules 14*c*. For instance, if wire 32*a* is selected to neutral at the electrical control apparatus 46, wire 32*b* to neutral, wire 32*c* to phase, and wire 32*d* to neutral, the first potential difference is created across heating modules 14*a* and 14*b* to generate radiant heat and the second potential difference is created across heating module 14*c*. Any number of potential differences across any number of combinations of heating modules 14 is contemplated.

The method of also includes removing, for example, a radiant heating module 14*c* shown in FIG. 7 for maintenance. Due to their separate electrical connections, the remaining radiant heating modules 14 are operable, together or in various combinations as discussed, without the radiant heating module 14*c*.

While preferred embodiments of the invention have been shown and described, those skilled in the art will recognize that other changes and modifications may be made to the foregoing embodiments without departing from the scope and spirit of the invention. For example, specific shapes of various elements of the illustrated embodiments may be altered to suit particular applications. It is intended to claim all such changes and modifications as fall within the scope of the appended claims and their equivalents.

That which is claimed is:

1. A radiant strip heating unit comprising:

a housing;

a plurality of heating modules each independently operable and removably disposed in the housing, each of the heating modules having a foil element adapted to be heated to a high temperature by passage of electricity through a respective one of the foil elements;

an electrical connection attached to at least one of the plurality of heating modules, the electrical connection configured to selectively energize the at least one of the plurality of heating modules to heat the foil element therein to heat an object disposed external to the housing; and a connection element configured to releasably connect at least two of the heating modules such that the respective foil elements of the at least two heating modules form a substantially continuous foil element configured to heat the object.

2. The heating unit as in claim 1, further comprising an electrical power control apparatus to selectively electrically energize a respective one of the foil elements.

3. The heating unit as in claim 2, wherein the respective foil element is adapted to rapidly heat in response to an electrical signal from the electrical power control apparatus through the electrical connection.

4. The heating unit of claim 2, wherein each of the plurality of heating modules has an electrical connection attached to each of the respective foil elements, the electrical power control apparatus configured to selectively electrically energize each electrical connection.

5. A radiant strip heating unit capable of selectively heating multiple zones, the heating unit comprising:

a housing;

a plurality of independently operable heating modules removably arranged in the housing, each heating module having a radiant heating element adapted to be heated to a temperature between 1200° Fahrenheit to about 1800° Fahrenheit by passage of electricity through the heating element;

means for selectively energizing any number of the plurality of heating modules; and a connection element configured to releasably connect at least two of the heating modules such that the foil elements of the at least two heating modules form a unified foil element configured to heat an object located in one of the multiple zones proximate an external portion of the housing.

6. The heating unit of claim 5, wherein each of the plurality of heating modules is affixed contiguously to another of the plurality of heating modules.

7. The heating unit of claim 5, wherein the means for selectively energizing includes an electricity source wire to supply electricity to the radiant heating element.

8. The heating unit of claim 5, wherein the means for selectively energizing includes an electricity source wire selectable to neutralize the radiant heating element.

9. The heating unit of claim 5, further including means for selecting any number of electricity source wires.

10. The heating unit of claim 9, wherein the means for selecting is an electrical power control apparatus.

11. The heating unit of claim 5, wherein the plurality of heating modules are disposed longitudinally adjacent each other.

12. The heating unit of claim 5, wherein the plurality of heating modules are disposed laterally adjacent each other.

13. The heating unit of claim 5, wherein at least one of the plurality of heating modules is disposed laterally and longitudinally adjacent to others of the plurality of heating modules such that the others of the plurality of heating modules are disposed about the at least one of the plurality of heating modules to provide a variable arrangement for radiant heat.

14. A method for rapid heat processing, the method comprising the steps of:

a) arranging a plurality of radiant heating modules in a housing in spaced relationship to each other, the plurality of radiant heating modules configured to operate independent of each other and releasably connectable such that respective foil elements of at least two of the heating modules form a substantially continuous foil element configured to heat an object located outside the housing;

b) selectively energizing any of the plurality of radiant heating modules by an electrical control apparatus, wherein at least one of the plurality of radiant heating modules produces radiant heat between 1200° Fahrenheit to about 1800° Fahrenheit; and c) exposing the object to the radiant heat for a predetermined time.

15. The method of claim 14, further comprising the substeps of energizing at least two of the plurality of radiant heating modules and varying an electricity supply to each of the plurality of radiant heating modules such that a temperature differential exists across the at least two of the plurality of radiant heating modules.

16. The method of claim 14, wherein step b) further comprises the substep of selecting an electricity supply to the at least one of the plurality of radiant heating modules and selecting at least another of the plurality of radiant heating modules to neutral such that a potential difference is created across the at least one of the plurality of radiant heating modules to generate heat.

17. The method of claim 14, further comprising the substep of selectively de-energizing the at least one of the plurality of radiant heating modules by the electrical control apparatus after passage of the predetermined time.

18. The method of claim 14, further comprising the substeps of removing for maintenance at least one of the plurality of radiant heating modules such that any one of the remaining plurality of radiant heating modules is operable without the removed at least one of the plurality of radiant heating modules.

* * * * *